US006450380B1

(12) United States Patent
Simhaee

(10) Patent No.: US 6,450,380 B1
(45) Date of Patent: Sep. 17, 2002

(54) PLASTIC BAG DISPENSER

(76) Inventor: Ebrahim Simhaee, 112 N. Maple Dr., Beverly Hills, CA (US) 90210

( * ) Notice: Subject to any disclaimer, the term of this patent is extended or adjusted under 35 U.S.C. 154(b) by 302 days.

(21) Appl. No.: 09/076,356

(22) Filed: May 12, 1998

(51) Int. Cl.[7] ..... B26F 3/02

(52) U.S. Cl. ..... 225/46; 225/79; 225/80; 225/90; 225/106; 221/26

(58) Field of Search ..... 225/53, 66, 81, 225/88, 91, 106, 51, 79, 26

(56) References Cited

U.S. PATENT DOCUMENTS

| | | | | | |
|---|---|---|---|---|---|
| 1,122,674 | A | * | 12/1914 | Winter et al. | 225/106 |
| 2,091,311 | A | * | 8/1937 | Fischer | 242/596.3 |
| 2,545,500 | A | * | 3/1951 | Stanley et al. | 225/66 |
| 2,664,252 | A | * | 12/1953 | Glew | 225/66 |
| 3,158,303 | A | * | 11/1964 | Pepitto | 225/66 |
| 3,713,569 | A | * | 1/1973 | Dashnier et al. | 225/51 |
| 3,799,466 | A | * | 3/1974 | Adams | 242/55.2 |
| 4,244,503 | A | * | 1/1981 | Kramer | 225/46 |
| 4,275,827 | A | * | 6/1981 | Cole | 225/77 |
| D264,406 | S | * | 5/1982 | Arnott | D6/96 |
| 4,627,560 | A | * | 12/1986 | Samuelson | 225/66 |
| 4,771,966 | A | * | 9/1988 | Anderson | 242/55.2 |
| 4,781,316 | A | * | 11/1988 | Freeberg | 225/71 |
| 4,915,316 | A | * | 4/1990 | Bastian | 242/55.2 |
| 5,335,811 | A | * | 8/1994 | Morand | 225/106 |
| 5,556,019 | A | * | 9/1996 | Morris | 225/106 |
| 5,573,168 | A | * | 11/1996 | Kannankeril et al. | 225/106 |
| 5,813,585 | A | * | 9/1998 | Kannankeril et al. | 225/106 |
| D409,027 | S | * | 5/1999 | Simhaee | D6/518 |

* cited by examiner

*Primary Examiner*—Allan N. Shoap
*Assistant Examiner*—Stephen Choi
(74) *Attorney, Agent, or Firm*—Darby & Darby

(57) ABSTRACT

A dispenser is described for dispensing plastic bags which are wound on a hollow cylindrical core. The dispenser is an integral molded plastic device having a bottom panel and upstanding sidewalls which are biased toward each other and which include stub axles adapted to receive the opposite ends of the core on which the roll is wound. The sidewalls apply a braking force to the ends of the core. The core fits tightly onto the stub axles to provide an additional braking force in order to prevent free wheeling of the roll as the individual bags are dispensed.

3 Claims, 3 Drawing Sheets

PLASTIC BAG DISPENSER

This invention relates to a plastic bag dispenser and, more particularly, to a plastic bag dispenser for use in the home.

U.S. Pat. No. 5,558,262 entitled Plastic Bag Dispenser discloses a number of plastic bag dispensers intended to be used in grocery stores and the like for dispensing individual plastic bags to consumers. The plastic bags shown and described in the '262 patent are formed in a star sealed configuration. A star sealed configuration is formed by fully gussetting a tubular film on both sides and then folding the fully guessetted web in half to form eight contiguous plies with a fold line along one edge. The web is then sealed and perforated with a central slot formed in the perforation line so that the bags can be dispensed one by one during use. The web is wound on a core which supports the roll of bags in the dispenser.

The present invention provides a relatively small and simple construction which can be used to dispense plastic bags. The invention is intended for home use although obviously dispensers made in accordance with the invention can be used wherever desired. In the preferred embodiment, the bags are the same as those used in the '262 patent, but the rolls are substantially smaller, i.e. there are fewer bags in a roll.

SUMMARY OF THE INVENTION

Briefly, in accordance with the invention, a dispenser for dispensing plastic bags wound in a roll on a hollow cylindrical core, comprises a molded plastic body having a bottom panel from which two sidewalls extend upwardly. The sidewalls converge slightly and include stub axles which receive the ends of the core on which the roll is wound. The sidewalls apply a braking force to the ends of the core and an additional braking force is applied by providing a close fit between the inner diameter of the core and the diameter of the stub axle.

THE DRAWINGS

DETAILED DESCRIPTION

Figure 1:
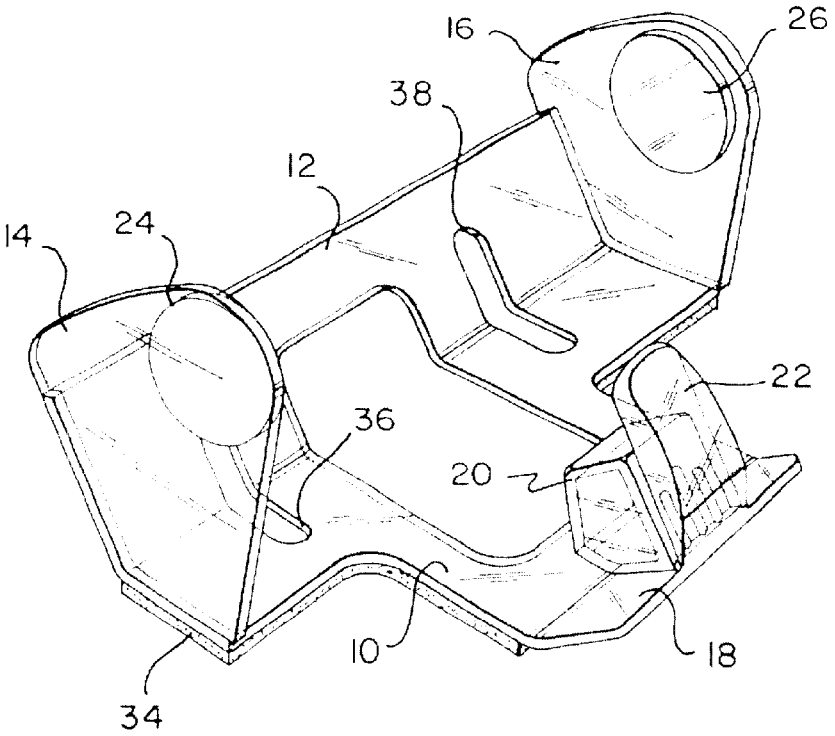
FIG. 1 is a perspective view of a dispenser in accordance with the invention.
Figure 2:
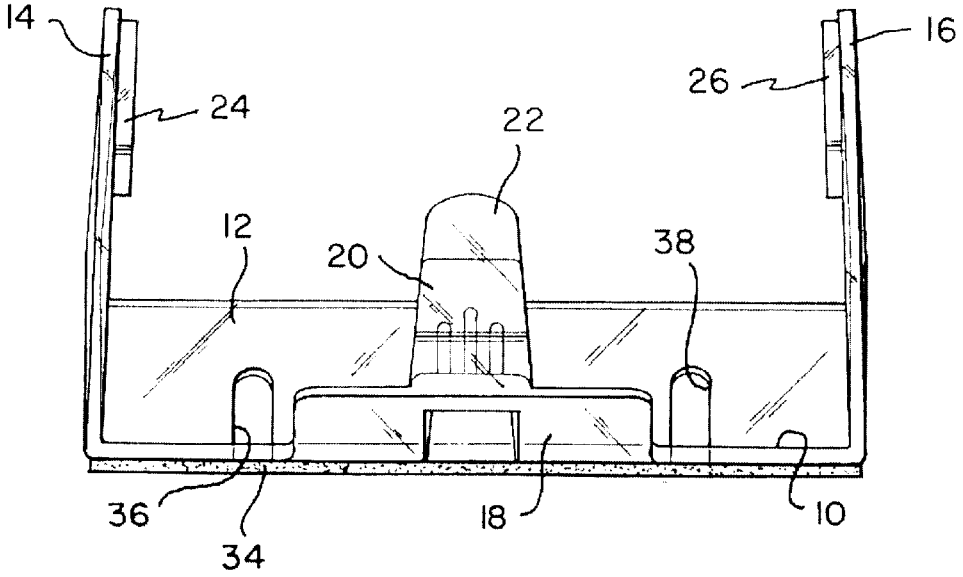
FIG. 2 is a front plan view of the dispenser shown in FIG. 1.

In the preferred embodiment, the dispenser is molded as a single unitary piece from a suitable plastic material such as polycarbonate. It includes a bottom panel 10, a sloped rear panel 12 and sidewalls 14 and 16. The walls 14 and 16 converge slightly from the bottom panel 10, i.e. the distance between the walls is greater at the bottom than at the top. As shown in FIG. 2, the side walls 14 and 16 include inwardly extending stub axles 24 and 26, respectively. A forward panel 18 extends upwardly from the front portion of the bottom panel 10 and includes a finger 20 and tongue 22 which are used to separate the individual bags as they are pulled from the roll. The operation of the finger 20 and tongue 22 are described in the '262 patent which is incorporated herein by reference. Although the finger and the tongue comprise the preferred means for separating the individual bags, other separating means can be used as well.

Figure 3:
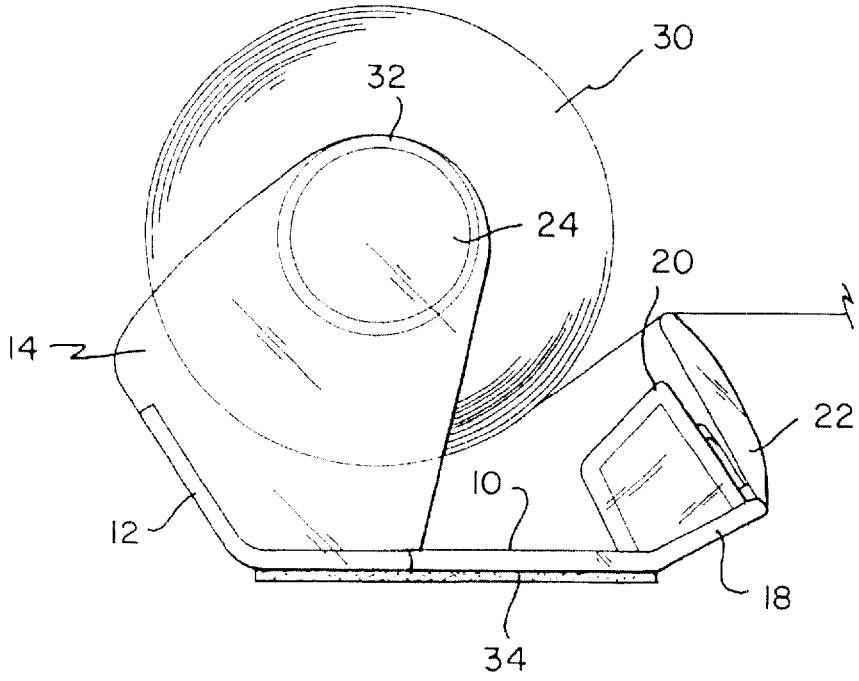
FIG. 3 is a side plan view of the dispenser showing a roll of plastic bags mounted within it.
Figure 4:
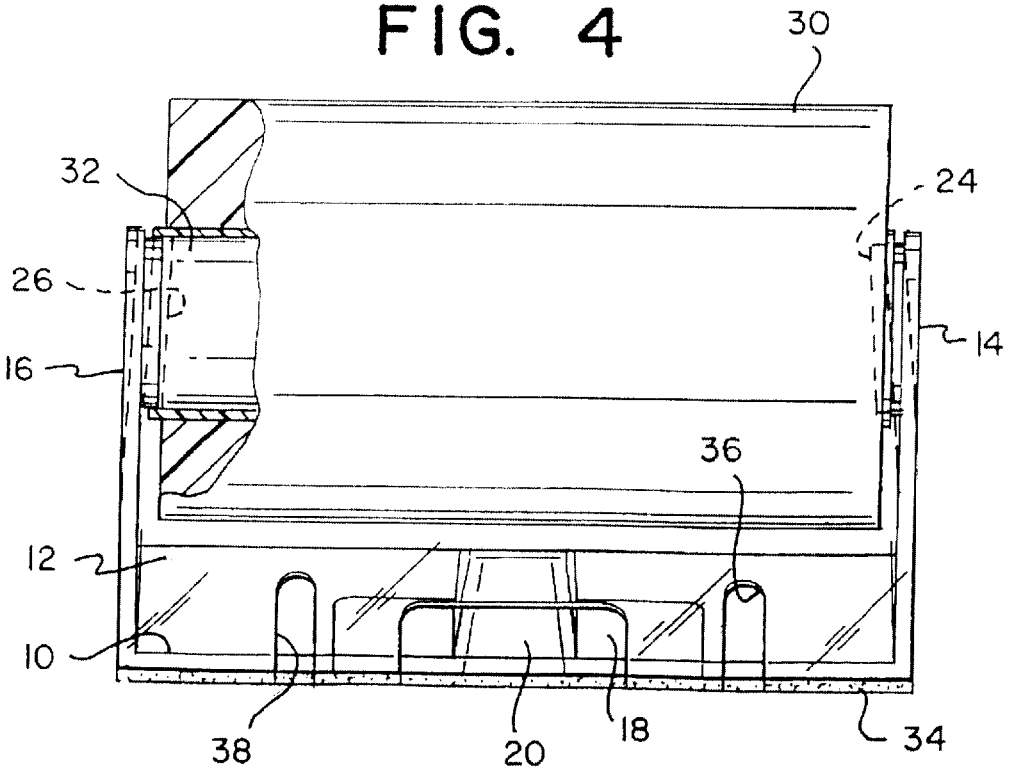
FIG. 4 is a rear view partially in section showing the dispenser with a roll of plastic bags mounted on a the stub axles.
Figure 5:
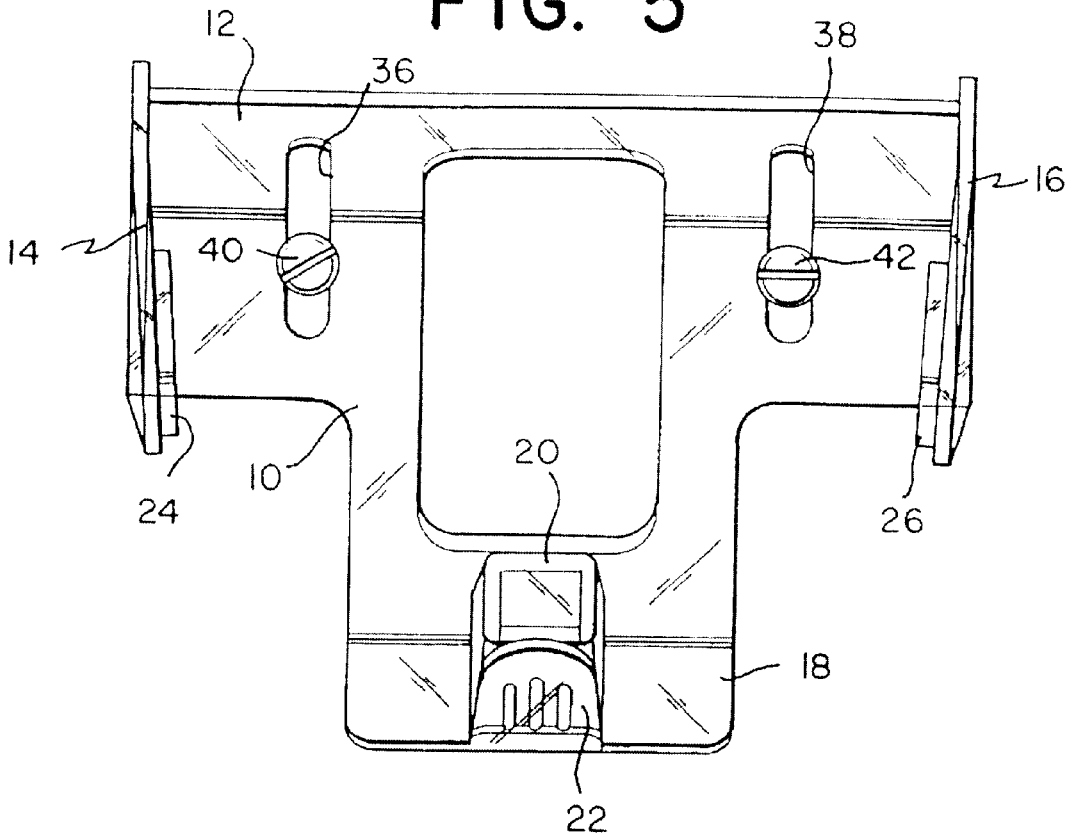
FIG. 5 is a top plan view of the dispenser.

As shown in FIGS. 3 and 4, the plastic bags 30 are wound on a core 32. By way of example, core 32 may be made of high density polyethylene which is extruded and cut to the desired length so that the tolerances can be tightly controlled.

The length of the core 32 is greater than the distance between the stub axles 24 and 26, so that when the roll is supported within the dispenser, the sidewalls 14 and 16 will be pushed apart by core 32 creating a spring bias which applies a braking force to the ends of the core. This is represented in FIG. 4 wherein the solid lines show the sidewalls 14 and 16 in their position after the core engages the axles 24 and 26, and dashed lines show the positions of the end walls before the roll is placed in the dispenser.

The ability to retard the rotation of the roll as the individual bags are dispensed is an important feature of the invention. In this device, a supplemental braking force is applied by providing for a close fit between the core 32 and the stub axles 24 and 26. This fit should not be so tight as to significantly hinder rotation of the roll but it should be tight enough to provide an adequate braking force so that, combined with the force applied by the end walls 14 and 16, the roll will not "free wheel" when the bags are dispensed. It has been discovered that good results are obtained when the inner diameter of the core is 0.015–0.020 inches greater than the diameter of the stub axles. If the difference is greater, the stub axles provide little or no drag on the roll.

The dispenser is small and light weight and can be readily mounted against any convenient surface, for example, in the user's kitchen. For mounting purposes, an adhesive pad 34 may be provided. The panels 10 and 12 also include slots 36 and 38 through which suitable fasteners such as screws 40 and 42 may be inserted to secure the dispenser to a mounting surface.

I claim:

1. A dispenser for dispensing plastic bags wound in a roll on a hollow cylindrical core, comprising a one piece, integral molded plastic body having a bottom panel, sidewalls extending upwardly from said bottom panel, and means for separating individual bags from said roll, wherein said sidewalls converge from said bottom panel so as to apply a braking force to a core supported between said sidewalls, said sidewalls each including an inner stub axle for receiving an end of said hollow cylindrical core, the diameters of the stub axles relative to the inner diameter of the core being such that the core can rotate on the axles but its rotation is retarded by friction between the inner surface of said core and the stub axles.

2. A dispenser according to claim 1, wherein the diameter of each of the stub axles is less than the diameter of the hollow cylindrical core which is to be supported on said stub axles by no more than 0.2 inches.

3. A dispenser according to claim 1, further including an adhesive on said bottom panel to enable the dispenser to be mounted on a support surface.

* * * * *

UNITED STATES PATENT AND TRADEMARK OFFICE

CERTIFICATE OF CORRECTION

PATENT NO. : 6,450,380 B1
DATED : September 17, 2002
INVENTOR(S) : Ebrahim Simhaee It is certified that error appears in the above-identified patent and that said Letters Patent is hereby corrected as shown below:

Column 2,
Line 59, delete "0.2" and substitute -- 0.02 --.

Signed and Sealed this

Twenty-seventh Day of May, 2003

JAMES E. ROGAN
*Director of the United States Patent and Trademark Office*